United States Patent [19]

Williamson

[11] Patent Number: 4,839,932

[45] Date of Patent: Jun. 20, 1989

[54] ADJUSTABLE BED SYSTEM

[76] Inventor: Robert M. Williamson, 1708 Matthews Rd., Austin, Tex. 78745

[21] Appl. No.: 54,203

[22] Filed: May 26, 1987

[51] Int. Cl.[4] ..... A47G 7/06; A47C 20/08

[52] U.S. Cl. ..... 5/68; 5/72; 5/446; 5/453

[58] Field of Search ..... 5/447, 453, 454, 455, 5/60, 68, 66, 67, 70–72, 431, 446

[56] References Cited

U.S. PATENT DOCUMENTS

| | | | |
|---|---|---|---|
| 3,781,928 | 1/1974 | Swallert | 5/433 |
| 4,309,783 | 1/1982 | Cammack et al. | 5/68 |
| 4,527,298 | 7/1985 | Moulton | 5/453 |

*Primary Examiner*—Alexander Grosz
*Attorney, Agent, or Firm*—J. F. Long

[57] ABSTRACT

An adjustable bed system comprising inflatable bags under a hinged mattress support frame with necessary air blowers to raise or lower a head end or leg end of the mattress. The total unit is portable and adapted to fit any size bed.

8 Claims, 3 Drawing Sheets

ADJUSTABLE BED SYSTEM

BACKGROUND OF THE INVENTION

Even though there have been several patents issued for various devices or systems to raise or lower portions of a bed to improve comfort and change position of the occupant, most have not been widely accepted.

With an increasing need for care for those bed-ridden for either short or long duration, there is an increasing need for such occupants to perform as many functions as practicable for themselves. Further, a proper adjustable system would allow increased comfort for those many people who read or watch TV while in bed.

As yet we find no economical, easily used, and easily installed system for operation by the occupant for adjusting either or both the "head" portion and "leg" portion of a bed.

We have considered the following patents in this general area:

| Patent Number | Inventor | Date |
|---|---|---|
| 2,769,182 | E. J. Nunlist | 11/06/56 |
| 3,392,723 | C. E. Calvin | 7/16/68 |
| 3,392,412 | J. R. Aymar | 7/16/68 |
| 3,606,623 | J. R. Aymar | 9/21/71 |
| 3,667,075 | W. D. Ballard, Et Al. | 6/06/72 |
| 3,978,530 | J. G. Amarantos | 9/07/76 |
| 4,287,620 | H. C. Zur | 9/08/81 |
| 4,309,783 | M. A. Cammack | 1/12/82 |

None of these fill the needs as outlined below for this invention. This present invention fills the need for:

1. a low cost system to adjust portions of a bed;
2. a system easily operable by fingertip control of the occupant;
3. a system variably adjustable within safe limits to raise either or both "head" portion of the bed and "leg" portion of the bed;
4. a system that smoothly returns the bed to normal flat position;
5. a system intrinsically safe and easily sanitized; and
6. a system with easily replaceable and readily available parts.

The invention utilizes air bags below a hinged frame to raise the "head" portion of the bed and in the same manner utilizes a second set of air bags to raise the portion of the bed below the occupant's knees. The system has several unique features designed for ease of installation, ease and economy of manufacture, low cost transportation, ease of sanitation and economical part replacements.

The system is designed to be used with a normal bed and with variation in size may be used with a single bed, a double or standard bed, a queen size or a king sized bed.

Briefly, the system comprises:

1. a metallic frame which may be of aluminum pipes which may be approximately 1" in diameter; the frame is hinged on either side of the bed and on either side of a flat section which may be about one foot in length with the flat section made to be fastened to the bed frame;
2. a canvas cover for the total frame with approximately 1½ inch thick polyurethane section or similar spongy material inside the canvas and inside the frame so that when the frame is slipped between the mattress and box springs that the mattress continues to be flat but approximately 1½ inch higher from the floor;
3. a first pair of motor-blowers both to inflate and deflate the bags under the head portion of the bed and a second pair of motor-blowers similarly to deflate or inflate the bags under the "foot" or "leg" portion of the bed;
4. an electrical system with switches available to the occupant of the bed with necessary safeguards;
5. pressure and vacuum cut-offs to prevent over-pressure of the bags or burn out of the motors by operation against a closed suction.

The motor-blowers used were standard vacuum cleaner motors (which have blower built in). Vacuum cleaner motor-blowers are commonly used with the air blowing back over the motor. The unique deflation/inflation set up in this invention may be briefly described in an overall way in the following paragraphs.

A vacuum cleaner motor-blower fits very neatly into a piece of 4½" PVC pipe and one motor-blower is slipped into the pipe with the motor facing in; a spring that fits loosely into the pipe is then slipped in and the second motor-blower is slipped in facing out so that we then have a spring separating the motor-blowers. We may activate one to blow air toward an inlet end of the assembly and, with this one deactivated the other one will pull air over the one that is deactivated so that by turning on one the air bags hooked to one end of this assembly will be inflated; by shutting off the one used to inflate the bags and activating the other the bags will be deflated.

One end of the assembly is closed with a cap containing an outlet fitting that fits closely into the pipe to hold the motor-blower while the other end is closed with a similar end cap that slips completely within the straight section of plastic pipe to hold the other motor-blower firmly against the spring separating the two motor-blowers. This end cap contains an opening that may fit against a diaphragm in a third end cap that fits within the straight piece of pipe. This third cap contains an air chamber behind the diaphragm and an equalizing line between this air chamber and the chamber formed where the spring holds the two motor-blowers apart. When the diaphragm in the third end cap is lifted up from the second end cap there is communication with the chamber formed over the top of the bell shaped second end cap. This chamber contains several holes which may be of ¾" diameter leading to the outside air.

In operation, when the inflation motor-blower is activated a vacuum is pulled on the spring containing chamber; the equalizing line from this chamber to the chamber in the third end cap pulls a slight vacuum in this third cap chamber thereby pulling the flexible diaphragm away from the second cap opening so there is then a path to pull outside air over the inactive deflation motor-blower, through the spring chamber and thence to inflate the air bags hooked to the first end cap via flexible tubing. When inflation to a desired point is completed and motor-blowers deactivated the diaphragm becomes an efficient check valve to hold air in the bags.

In order to deflate the bags the inflation motor-blower is deactivated and the deflation motor-blower is activated. Because of the equalizing line between the spring chamber and third end cap the pressure on either side of the diaphragm is the same but as soon as the deflation motor-blower is activated the blower outlet pressure will raise the diaphragm providing an air path to the exterior.

This briefly describes a unique system that meets the objectives outlined. Total weight of the system may be less than 75 pounds so that it is easily portable and shippable. The mass produced vacuum cleaner motor-blowers are quite inexpensive and fit into inexpensive housings. In fact, the system used for deflation or inflation of the bags may be cheaper than an alternative system using only one motor-blower with a complex valving system. Various details have been left out of the above brief outline for clarity and brevity but would be easily supplied by one of normal skill in mechanical and electrical arts. A more complete explanation of a preferred embodiment will be found in the remaining specification and claims.

Many minor changes in details of this invention could be made but would still come within the spirit and purpose and fulfill objectives outlined. For example, the support frame could be of molded plastic with hinges molded in the frame; the motor-blower pair could be replaced with one motor-blower with microprocessor controlled valving or could be replaced with one blower for inflation and one for deflation with proper valving.

STATEMENT OF THE INVENTION

The present invention comprises:

(a) a support assembly consisting of a cloth or canvas fitted over a hinged frame and containing a spongy material such as foamed polyurethane in such manner as to maintain the mattress flat in the rest position but to have canvas easily removed for washing;

(b) in a first embodiment, a canvas bellows comprised of multiple bags with each canvas bag replacably containing a plastic or rubber inflatable pillow shaped bag and so designed as to be placed under the foregoing hinged frame to raise portions of the bed by inflating the bellows; in a second embodiment, the plastic bags may be made in one or two units and used without the canvas bag containers;

(c) an easily replaced inflatable bag contained in each of the bellows in the first embodiment so that all bags may be temporarily removed for washing the canvas bellows or alternatively in the second embodiment only plastic bags are used and they may be sanitized with commercially available agents or cheaply replaced;

(d) two assemblies each containing two motor-blower units, air chambers, and a simple diaphragm valve to allow inflation of the plastic bags to raise the bed to any desired position and to remove the air to allow smooth return of the bed to the flat or "rest" position;

(e) a three position switch for each motor-blower assembly to allow finger tip control so one motor-blower fills the bellows to raise the "head" portion of the bed with the switch in one position, whereas putting the switch in the other active position activates the other motor-blower to evacuate the bellows to return the bed smoothly to flat position;

(f) a switch and motor-blower assembly raises and lowers the "leg" portion of the bed in the same way as outlined for the "head" portion;

(g) cut-off switches position-activated to cut off the motor when the head portion or leg portion reaches a desired maximum elevation; a normal mercury switch may be properly positioned in the hinged frame to accomplish this function;

(h) means to anchor the hinged support frame to the bed frame; in one embodiment, two pipes on each side of the bed were connected to the support frame and were fitted into two larger pipes fastened to a steel plate with the plate then clamped to the bed frame;

(i) means to hold down the foot end of the hinged frame so that inflation of the bags raises the mattress in the knee area;

(j) a retainer bag fastened over the foot of the mattress and then tied to the bed frame to prevent the slippage of the mattress that would otherwise occur as the air bags are inflated.

A plastic support frame of sufficient rigidity could replace the hinged support frame we have described in detail.

As described, the hinged frame with bags deflated and hoses disconnected that lead from the motor-blower units will fold neatly into a package easily carried by one man. The motor-blower units, wiring, and hoses may be neatly fitted into a second carrying case and are also easily carried. This portability and ease of installation is an important feature of the system. It is anticipated that a major use may be for those people who relax and read or watch TV in bed. Of course, the invention also fulfills the need for temporary conversion of a normal bed to be similar to a hospital bed.

DETAILED DESCRIPTION OF THE DRAWINGS

Figure 1:
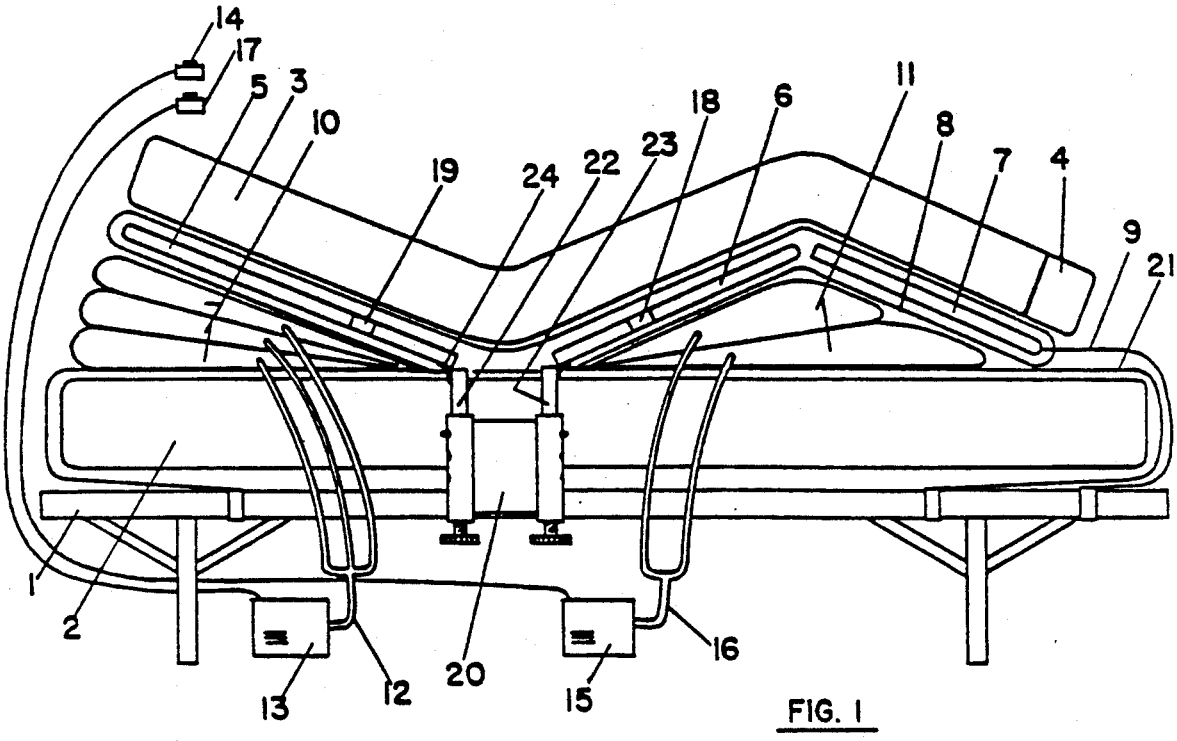
FIG. 1 shows a side view of the Adjustable Bed System in use with a mattress with both head portion and leg portion in a raised position.
Figure 2:
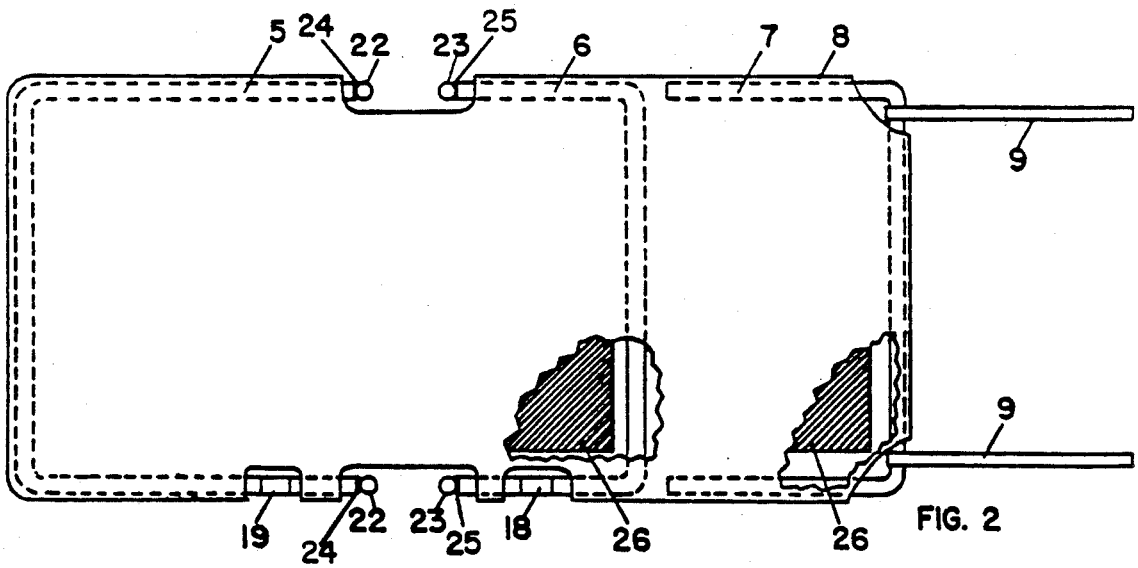
FIG. 2 shows top view details of a support frame used below the mattress and above the inflatable bags used to raise and lower either the head portion or leg portion of the mattress.

FIG. 1 shows a side view of the Adjustable Bed System with both the head end and leg end of the mattress in a raised position. In FIG. 1, we show a bed frame 1, box spring 2, mattress 3, a cloth mattress retainer 4 that may be sewed to the canvas bag covering 8; this canvas bag covering 8 holds in one unit a first section 5, a second hinged section 6 and a third section 7 of the assembly mattress support unit. The first section 5 may be approximately 1" diameter tubular aluminum pipe bent in a U shape and terminating in a hinged portion 22 on each end of the U shape, hinge 24 of this hinged portion 22 being outside the canvas bag covering 8. A second hinged section 6 is of similar shape but with each leg of the U being shorter than in the first portion 5. In a similar fashion to the first section 5, this second section 6 is a U shape frame but facing the opposite direction from section 5 and terminating on each leg of the U with a hinged portion 23 designed to fit into the receiving pipes on clamp 20 in the same way as hinged portion 22. The second section 6 contains an electrical switch 18 which may be a mercury switch designed to break an electrical circuit when section 6 is in a maximum raised position. In the same way, section 5 contains a similar electrical switch 19. A third section 7 is also U shaped with the legs pointing toward the center of the bed when the assembly is in use. Not shown here but indicated in FIG. 2, 26 are two sections of polyurethane foam approximately 1½" thick with one section filling the space between section 5 and 6 and a second section filling the space in section 7. Other spongy type materials would serve the same purpose of allowing the mattress 3 to be flat when air bags 10 and 11 are deflated. Completing the hinged support assembly as already described are tie down straps 9 that tie each end of the U shaped frame 7 loosely to the bed frame or bed rails 1. These straps 9 allow the mattress 3 to move sufficiently to form the raised portions as shown by holding the very lower end close to the box springs to cause the air bags 11 to give desired mattress position as shown when inflated. Anchor straps 21 hold the air bags canvas covering 37 in place. A three position switch 17 operates motor-blower unit 15 and a similar three position switch 14 operates motor-blower unit 13. Inlet lines 12 go to head end air bags 10 and inlet lines 16 go to leg end air bags 11.

In FIG. 2, we show a top view of the assembly support unit with the first section 5 terminating in hinged portion 22 connected to hinges 24; the second section 6 terminating in hinged portions 23 connected to hinges 25 and the third section 7 terminating in rounded ends and being loosely tied down to the bed frame with tie down straps 9. Cut-a-way sections of the canvas bag or envelope 8 that holds the assembly together show the 1½" thick polyurethane sections 26 that fill the canvas envelope 8 so that when air bags 10 and 11, FIG. 1, are deflated the mattress 3 FIG. 1, lies flat on the air bag unit 21 FIG. 5 or 39 FIG. 6, which lies on top of the box springs 2, FIG. 1. Position cut-off switches 19 FIG. 1, on head end and 18 FIG. 1, on leg end limit upward position of head end and leg end.

Figure 3:
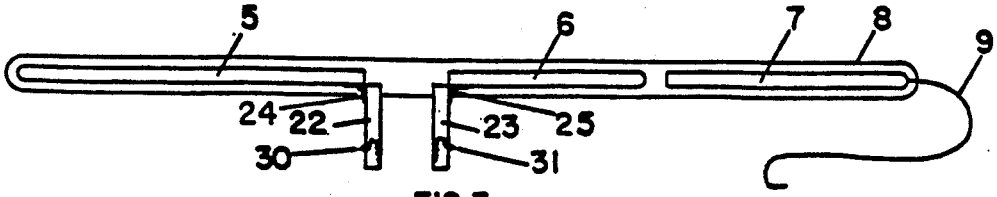
FIG. 3 shows side view details of the support frame.

FIG. 3 is a side view of the support assembly showing hinged section 22 and hinge 24 of section 5 which would be outside the canvas envelope 8 and contains a spring loaded pin 30, which pin allows height adjustment in clamp 20, FIG. 1. Similarly, hinged section 23 with hinge 25 of section 6 contains a spring loaded pin 31 which also fits into clamp 20, FIG. 1. Section 7 is contained in the canvas envelope 8 along with section 5 and 6. Tie down straps 9 serve to hold down the lower end of section 7.

Figure 4:
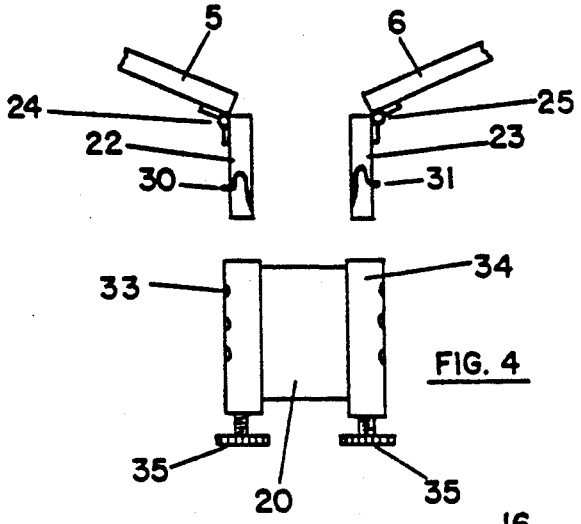
FIG. 4 shows details of a clamp used to anchor the support frame firmly to the bed rails.

FIG. 4 shows clamp 20 and sections 22 and 23 of the support assembly hinged sections 5 and 6 with hinges 24 and 25. A spring loaded pin 30 is contained in hinged portion 22 with hinged portion 22 being conveniently made from aluminum pipe. The spring loaded pin 30 may be made as indicated but other ways of making a spring loaded pin would be equally suitable. Spring loaded pin 31 is similar to spring loaded pin 30 and is inside a tubular section 23. Tubular sections 33 and 34 are larger than hinged portion 22 and tubular sections 23; contain spaced openings to secure spring loaded pins 30 and 31, and are rigidly connected to flat plate body of clamp 20. Screw clamps 35 may be used to clamp body 20 securely to the bed rails 1, FIG. 1. There is a similar set up on each side of the bed, and sections 5 and 6 of the support assembly may be rigidly clamped in place.

Figure 5:
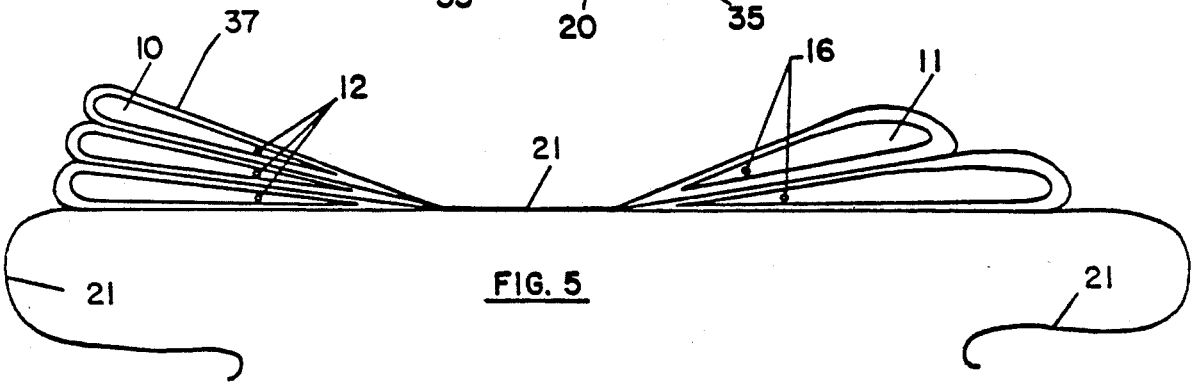
FIG. 5 shows one embodiment of an air bag assembly used below the Hinged Support Frame, FIG. 2.

FIG. 5 shows one preferred embodiment of the air bag unit 21 wherein plastic inflatable bags 10 on the head end and 11 on the leg end are contained in canvas envelopes 37. Connections 12 shown for each of the head end air bags 10 and connection 16 for the leg end bags both of which may be ⅜" plastic nipples formed in the inflatable plastic bags 10 and 11. We have shown three bags in the head end and two bags in the leg end and all bags are shown equal size and this embodiment works well. However, the number and size of the air bags could vary and come within the spirit of this invention. The canvas bags of the of the air bag covering 37 may be conveniently made by folding and sewing one piece of canvas but methods of manufacture would be easily varied by one of ordinary skill in the trade. Tie down straps 21 are used to hold the air bag covering 37 in proper position on top of box springs 2, FIG. 1.

Figure 6:
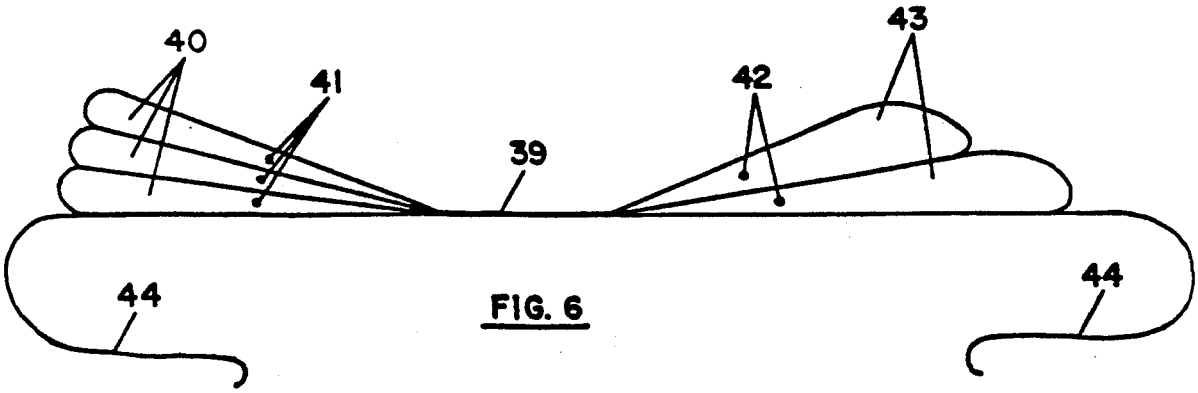
FIG. 6 shows a second embodiment of an air bag assembly that may be used below the hinged support frame, FIG. 2.

FIG. 6 shows a second embodiment of the air bags 40 to lift the head end and air bags 43 to lift the leg end of a bed. Inlet-outlet nipples 41 and 42 for the air bags may be ⅜" diameter plastic fused into the plastic air bags. The bottom portion of the air bag unit 39 is connected to all air bags by fusion, sewing or glueing to a canvas section with tie down straps 44 to tie to bed rails 1, FIG. 1 to anchor unit 39 in place.

Figure 7:
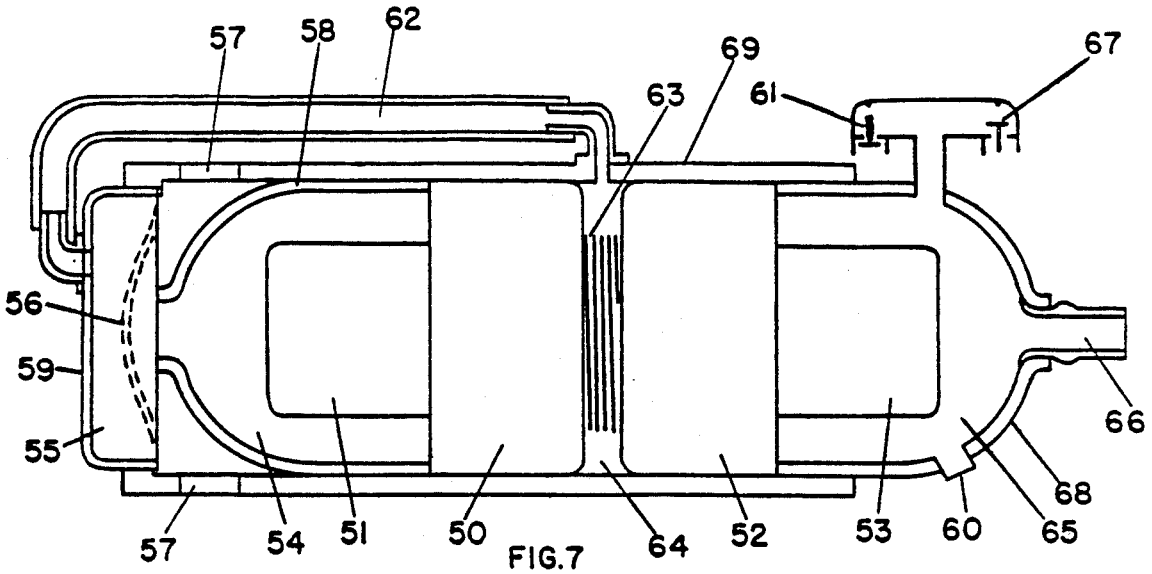
FIG. 7 shows details of a first motor blower unit that may be used to inflate and deflate air bags shown in FIG. 4 or FIG. 5 on the head end of the system.

FIG. 7 shows one unit containing two common vacuum cleaner motor-blower units. There are two of these units, one, FIG. 7 being for inflation and deflation of the air bags, at the head end and the other exactly similar unit FIG. 8 being to inflate or deflate the air bags at the foot end of the unit.

Looking at FIG. 7, the unit may be conveniently assembled by glueing end cap 58 in a first section of pipe 69, and with terminal cap 59 being glued into a first end of pipe 69 which contains up to eight holes 57 that may be ¾" in diameter between end cap 58 and lower portion of terminal lens cap 59; the terminal end cap 59 containing a flexible diaphragm 56, and air chamber 55 and a connection for the equalizing line 62. The motor 51 and attached blower 50 is pushed into pipe section 69 to fit snugly against the end cap 58. A spring 63 that may be 3" in diameter and exert up to 15 pounds force when compressed to approximately 1" is placed between blower 50 and the second blower 52, motor 53 unit. This spring space forms chamber 64 which communicates with end cap 59 through equalizing line 62 which may be ½" in diameter. End cap 68 may then be fastened in a second end of pipe 69 so as to seat against blower 52 and to properly compress spring 63. End cap 68 may contain a positive pressure relief valve 61, a vacuum relief valve 67, a vacuum operated electrical cut-off switch 60 and an outlet nipple 66.

Operation of this dual two way blower we have described will be as follows:

1. When blower 52 is activated by a two way electrical switch 14, FIG. 9, the blower will pull a vacuum in chamber 64 FIG. 7 and through the equalizing line 62 the pressure will be reduced in chamber 55 causing the flexible diaphragm 56 to lift off the seat on the end cap 58 and outside air may then flow through holes 57 over the inactive blower 51, motor 50 and thence through chamber 64 and over motor 53 to inlet nipple 66, which is hooked to inflate the plastic bags, FIG. 5, or FIG. 6. The pressures and sizes of equalizing line 62, diaphragm 56 and holes 57 are such in the unit as described that air continues to flow to inflate the bags until the user throws the switch 14 or until the position switch 19, FIG. 1 deactivates the motor 53. When the bags are inflated and motor 53 is deactivated back pressure through the equalizing line 62 pressures chamber 55 so that this pressure cause flexible diaphragm 56 to close firmly, the diaphragm acts as a very efficient check valve to hold the bags inflated.

Figure 9:
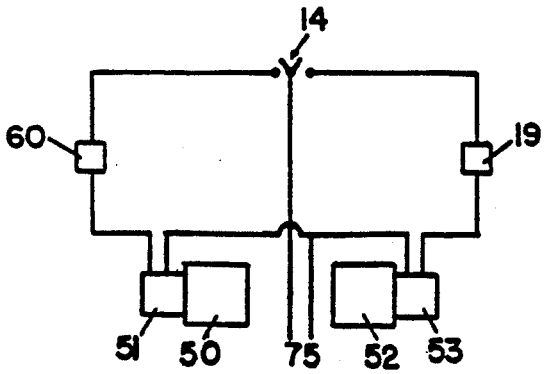
FIG. 9 shows details of an electrical circuit for the first motor-blower unit.

When the occupant wishes to lower the head end of bed by deflating the plastic bags on the head end he pushes the two way switch 14 FIG. 9 so that motor 51 is activated starting blower 50. The pressure in chamber 64 is equalized with the pressure in chamber 55 but the output pressure in chamber 54 from blower 50 coupled with a slight pressure reduction in chamber 64 and thereby in chamber 55 is sufficient to lift diaphragm 56 so that air from the plastic bags may flow to the outside through holes 57. When the air is completely removed from the bags the pressure will drop in chamber 65 and vacuum switch 60 will stop the motor 51 if the activation switch 14, FIG. 9, is in closed position. This prevents motor 51 burn out by automatically shutting off motor 51 when bags are completely deflated.

Figure 8:
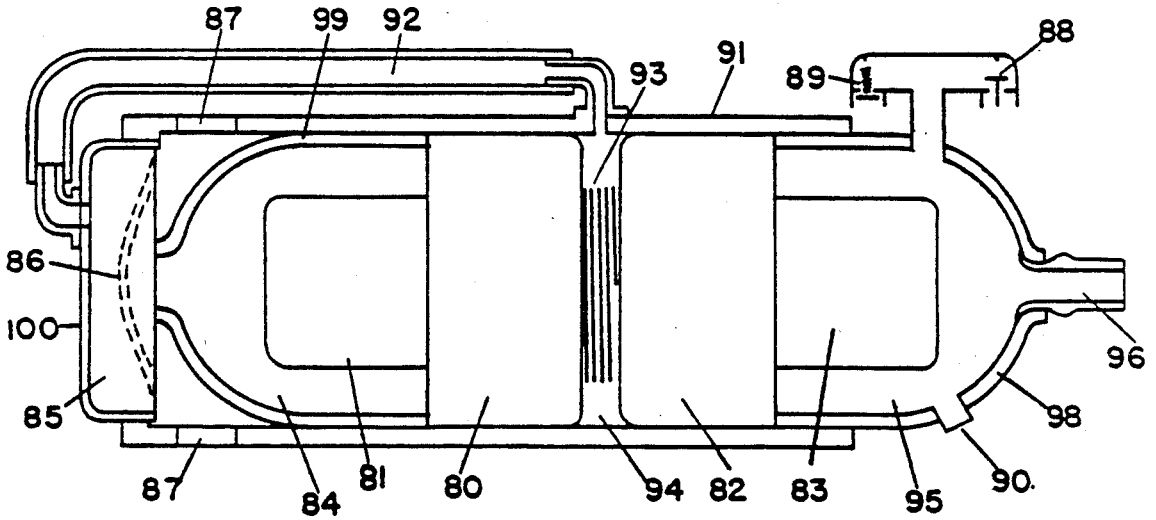
FIG. 8 shows a second motor-blower unit (exactly the same as the first motor-blower unit) used to deflate and inflate air bags shown in FIG. 4 and FIG. 5 under the leg end of the mattress with cut-offs of this unit by a position switch in the "head" and "leg" end of the assembly frame.

FIG. 8 shows the second dual motor-blower unit which is used to inflate or deflate the bags at the leg end of the bed. Briefly, since we have described the similar unit in detail, we see blower 80 and motor 81 used for deflation contained in a bell shaped cap 99 with air chamber 84 communicating with outside air through holes 87 in containment structure or pipe 91 when flexible diaphragm 86 is in a raised position. Chamber 85 formed by end cap 100 and flexible diaphragm 86 will be equalized in pressure with spring chamber 94 through equalizing line 92.

Blower 82 and motor 83 serve to inflate leg end bags and are held in place by spring 93 and end cap 98. End cap 98 contains chamber 95, nozzle 96, a vacuum cut-off switch 90 and a vacuum relief valve 88 and pressure relief valve 89.

FIG. 9 shows the electrical circuits used with the dual motor-blower units used for inflating and deflating the head end bags 10, FIG. 1 and described in detail under FIG. 7. In the circuits there is shown a 110 V source (75) with one side of the circuit leading to a switch 14, this switch may be spring loaded to return to an open position with finger tip control to activate either head end bags 10, FIG. 1, or leg end bags 11, FIG. 1. The switch may also be replaced or activated by pneumatic controlled switch that will act the same as switch 14. Various other type switches may be used to perform functions of switch 14. When switch 14 is positioned to close the circuit through position switch 19 (shown in place FIG. 1) through motor 53 and back to inlet 110 V source 75, the air bags 10, FIG. 1 will inflate. Note, using the desireable spring loaded-to-open switch 14 the bed will stay in position after inflation of the air bags because of diaphragm 56, FIG. 7, acting as a check valve as previously explained. When switch 14 is depressed to close the circuit through vacuum cut-off switch 60, FIG. 7, and through motor 51 back to 110 V source 75, the blower 50 will be activated to deflate air bags 10, FIG. 1. The vacuum cut-off switch 60 will open to stop motor 51 if the occupant continues to hold switch 14 in position after the bags 10, FIG. 1, are completely deflated. This is desireable to prevent damage to motor 51.

Figure 10:
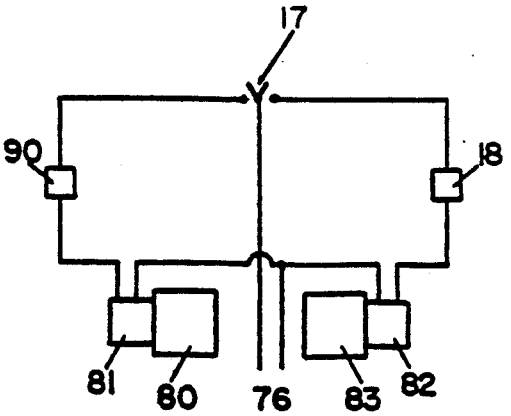
FIG. 10 shows a second electrical circuit similar to the electrical circuit, for the second motor-blower unit.

FIG. 10 shows an exactly similar circuit to that of FIG. 9 but is included here for clarity. Briefly the circuit shows inlet 110 V source 76 with one leg of the 110 V circuit leading to a central pole of two pole switch 17 which is loaded to open. When switch 17 is positioned by the occupant to close the circuit through position switch 18, FIG. 1, the motor 82 will be activated and blower 83 will then act to inflate the leg end bags 11, FIG. 1. The position switch 18 will operate to deactivate motor 83 when the maximum desireable elevation of the lower portion of the bed is reached even if the occupant holds the switch 17 in a closed position too long. When switch 17 is depressed so as to close the circuit through vacuum cut-off switch 90 and through motor 81 the blower 80 is activated to deflate leg end bags 11, FIG. 1. Vacuum cut-off switch 90 deactivates motor 81 if the occupant holds switch 17 in place too long. This protects motor 81.

I claim:

1. An adjustable bed system comprising:

A. a three section hinged mattress support frame;

B. fastening means (20) to hold said three section mattress support frame to a bed (1) above a box springs (2) and below a mattress (3);

C. a spongy resilient material (26) up to 3" thick contained within the perimeter of said three section hinged mattress support frame with a cloth covering (8) to contain said three section hinged mattress support frame and said spongy resilient material (26); said cloth covering (8) having suitable openings to allow connection of said three section hinged mattress support frame to said fastening means (20);

D. tie down straps (9) to loosely anchor the leg end of said three section hinged mattress support frame to bed (1);

E. a first inflatable means (10) below a head end of said three section hinged mattress support frame to raise and lower said head end and a second inflatable means (11) below a leg end of said three section hinged mattress support frame to raise and lower said leg end;

F. a first means comprising a first motor-blower unit (13) with suitable valves and switches to inflate and deflate said first inflatable means (10) and a second means comprising a second motor-blower unit (15) with suitable valves and switches to inflate and deflate said second inflatable means (11).

2. An adjustable bed system as in claim 1 where said hinged mattress support frame comprises:

A. a first U shaped frame (5) with each leg of said first U shaped frame (5) terminating in a first straight short section (22) hinged perpendicular to a flat plane of said first U shaped support frame (5) to fold back upon said first U shaped frame (5);

B. a second U shaped frame (6) with each leg of said second U shaped frame (6) terminating in a second straight short section (23) hinged perpendicular to a flat plane of said second U shaped frame to hold back upon said second U shaped frame (6) with said second short section (23) facing said first straight short section (22);

C. a third U shaped frame (7) with legs of said third U shaped frame terminating with rounded ends with top of said third U shaped frame (7) facing out with said tie down straps (9) attached to said top.

3. An adjustable bed system as in claim 1 where said fastening means to hold said three section hinged mattress support frame comprises:

A. a clamp (20) on each side of said bed with said clamp (20) having a flat section; two open pipes (33 and 34), one connected to each side of said flat section (20) and containing holes so positioned that spring loaded pins (30 and 31) of said first short hinged section (22) and said second short hinged section (23) will adjustably fit into said pipes (33 and 34) containing holes; clamps (35) integrally attached to said flat section (20) so positioned as to allow clamping said flat section (20) to a bed rail with said open pipes of said clamp in an upright position.

4. An adjustable bed system as in claim 1, where said first inflatable means (40, FIG. 6), to raise and lower said head end of said three section hinged mattress support frame and said second inflatable means (43) to raise and lower said leg end of said three section hinged mattress support comprises:

A. a flat reinforced plastic strip of a similar width and length of said mattress with tie down straps (44) to go over said box spring (2) and tie to said bed frame (1);

B. a first multiplicity of inflatable plastic bags (40 FIG. 6) each equipped with means (41) to flexibly connect to said first means to inflate and deflate said first inflatable means (40) and each of said first multiplicity of inflatable plastic bags fastened at a center portion of said flat reinforced plastic strip C. a second multiplicity of inflatable plastic bags (43 FIG. 6) each equipped with means (42) to flexibly connect to said second means (15) to inflate and deflate said second inflatable means (43) and each of said second multiplicity of inflatable plastic bags (43) fastened at a center portion of said flat reinforced plastic strip.

5. An adjustable bed system as in claim 1, wherein cut-off switches (19 and 18) in said head end and said leg end limit travel of said three section mattress support frame by deactivating said first motor-blower unit (13) and said second motor-blower unit (15) when maximum safe elevation is reached.

6. An adjustable bed system as in claim 1 where said first motor-blower unit (13) further comprises:

A. a first motor-blower (52 and 53) with a discharge connecting with said first multiplicity of inflatable plastic bags (10) and with a suction communicating with outside air through a chamber (64) containing a spring (63) over and around a second motor-blower (50 and 51) under a flexible diaphragm (56) contained in a diaphragm chamber (55) and covering an opening in a bell shaped chamber (54) containing a second motor-blower system (50 and 51); said diaphragm chamber (55) communicating with said chamber (64) containing a spring (63) through a first equalizing line (62) so that when said first motor-blower (52 and 53) is activated a decrease in pressure in said chamber (64) containing a spring (63) causes a decrease in pressure above said flexible diaphragm (56) in said diaphragm chamber (55) thereby causing said flexible diaphragm (56) to raise to uncover said opening in said bell shaped chamber (54) containing said second motor-blower (50 and 51), thus, allowing air to come through holes (57) contained in a chamber formed by an end of said bell shaped chamber (54) and said diaphragm (56);

B. said second motor-blower (50 and 51) with suction of said blower (50) of said motor-blower (50 and 51) opening to said chamber (64) containing a spring (63) with discharge of said blower (50) of said motor-blower (50 and 51) communicating to outside atmosphere through said chamber (54) containing said second motor-blower (50 and 51) and an opening covered with said flexible diaphragm (56) contained in said diaphragm chamber (55) and thence to outside air through holes (57) contained in said chamber formed by said end of said bell shaped chamber (54) and said flexible diaphragm (56) with said flexible diaphragm (56) being lifted by a combination of discharge pressure from said blower (50) of said second motor-blower (50 and 51) and a decrease in pressure in said spring chamber (64) equalizing through said first equalizing line (62) to reduce pressure in said diaphragm chamber (55) above said flexible diaphragm (56);

C. an electrical circuit (FIG. 9), containing a spring loaded two way switch (14) with a connection through a first side of said two way switch to actuate said motor (53) in said first motor-blower (53 and 52) through a position switch (19) in said first motor-blower (53 and 52) through a position switch (19) in said second section of said hinged mattress support frame, said position switch (19) operating to open said circuits thereby stopping said first motor-blower (53 and 52) when said leg section reaches a maximum position.

7. An adjustable bed system as in claim 1 where said second motor-blower unit (15) further comprises:

A. a first motor-blower (83 and 82) with discharge (96) connecting with said second multiplicity of inflatable plastic bags (11) and with a suction communicating with outside air through a chamber (94) containing a spring (93) over and around a second motor-blower (81 and 80) under a flexible diaphragm (86) contained in a diaphragm chamber (85) and covering an opening in a bell shaped chamber (84) containing a second motor-blower (81 and 80); said diaphragm chamber (85) communicating with said chamber (94) containing a spring (93) through a first equalizing line (92) so that when said first motor-blower (83 and 82) is activated a decrease in pressure in said chamber (94) containing a spring (93) causes a decrease in pressure above said flexible diaphragm (86) in said diaphragm chamber (85), thereby causing said flexible diaphragm (86) to raise to uncover said opening in said bell shaped chamber (84) containing said second motor-blower (81 and 80) thus allowing air to come through holes (87) contained in a chamber formed by an end of said bell shaped chamber (84) and said diaphragm (86);

B. a second motor-blower (81 and 80) unit with suction of said blower (80) of said motor-blower (81 and 80) opening to said chamber (94) containing a spring (93) with discharge of said motor-blower (81) and (80) communicating to outside atmosphere through said chamber (84) containing said second motor-blower (81 and 80) and an opening covered with said flexible diaphragm (86) contained in said diaphragm chamber (85) and thence to outside air through holes (87) contained in said chamber formed by said end of said bell shaped chamber (84) and said flexible diaphragm (86); said flexible diaphragm (86) being lifted by a combination of discharge pressure from said blower (80) and a decrease in pressure in said spring chamber (94) equalizing through said first equalizing line (92) to reduce pressure in said diaphragm chamber (85) above said flexible diaphragm (86);

C. an electrical circuit (FIG. 10), containing a spring loaded two way switch (17) with a connection through a first side of said two way switch (17) to actuate said motor (82) through a position switch (18) in said second section (6, FIG. 1), of said three section hinged mattress support frame to inflate said bags (11) under said leg end of said mattress support, said position switch (18) operating to open said circuits thereby stopping said first blower motor unit (82 and 83) when said leg section reaches a maximum position.

8. An adjustable bed system comprising:

A. a three section hinged mattress support frame;

B. fastening means (20) to hold said three section hinged mattress support frame to a bed (1) above a box spring (2) and below a mattress (3);

C. a spongy resilient material (26) up to 3" thick contained within the perimeter of said three section hinged mattress support frame with a cloth covering (8) to contain said three section hinged mattress support frame and said spongy resilient material (26); said cloth covering (8) having suitable openings to allow connection of said three section hinged mattress support frame to said fastening means (20);

D. tie down straps (9) to loosely anchor leg end of said mattress support frame to bed (1);

E. a first inflatable means (10) below a head end of said mattress support frame to raise and lower said head end and a second inflatable means (11) below a leg end of said mattress support frame to raise and lower said leg end;

F. a pressuring and depressuring means to inflate and deflate said first inflatable means (10) and said second inflatable means (11).

* * * * *